US009279207B2

(12) United States Patent
Yu et al.

(10) Patent No.: US 9,279,207 B2
(45) Date of Patent: Mar. 8, 2016

(54) WASHING MACHINE WITH A SUSPENSION HAVING A FRICTION DAMPER

(75) Inventors: Insik Yu, Seoul (KR); Youngjong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 980 days.

(21) Appl. No.: 13/162,645

(22) Filed: Jun. 17, 2011

(65) Prior Publication Data

US 2011/0308281 A1 Dec. 22, 2011

(30) Foreign Application Priority Data

Jun. 17, 2010 (KR) ..... 10-2010-0057763
Dec. 24, 2010 (KR) ..... 10-2010-0134741

(51) Int. Cl.
*D06F 37/24* (2006.01)
*D06F 37/22* (2006.01)

(52) U.S. Cl.
CPC ..... *D06F 37/24* (2013.01); *D06F 37/22* (2013.01)

(58) Field of Classification Search
CPC ..... D06F 37/20; D06F 37/22; D06F 37/24; F16F 7/08; F16F 7/09; F16F 13/02; F16F 13/04; F16F 15/022
USPC ..... 68/212; 188/381
See application file for complete search history.

(56) References Cited

U.S. PATENT DOCUMENTS 5,117,659 A 6/1992 Sharp et al. ..... 68/23.3
5,606,879 A 3/1997 Froelicher et al. ..... 68/23.3
5,946,946 A * 9/1999 Sharp et al. ..... 68/23.1
6,009,730 A 1/2000 Lee
6,397,643 B1 6/2002 Chang et al.
2006/0231725 A1* 10/2006 Rebolledo ..... 248/638
2009/0031760 A1 2/2009 Kim et al.

FOREIGN PATENT DOCUMENTS

CN 1059587 A 3/1992
CN 1199789 A 11/1998
CN 1221050 A 6/1999
CN 1275648 A 12/2000
CN 101387062 A 3/2009

OTHER PUBLICATIONS

International Search Report issued in PCT Application No. PCT/KR2011/004441 dated Dec. 7, 2011.
Chinese Office Action dated Sep. 29, 2014, issued in Application No. 201180033436.5.

* cited by examiner

*Primary Examiner* — Jason Ko
*Assistant Examiner* — Spencer Bell
(74) *Attorney, Agent, or Firm* — KED & Associates LLP

(57) ABSTRACT

A washing machine is provided. The washing machine may include a casing, an outer tub, and a suspension. The suspension may include a support rod, a cap, a first elastic member, and a friction damper. The support rod may be connected to the casing at one end thereof. The support rod may penetrate the cap, and the cap may move upward and downward along the support rod according to an amount of vibration of the outer tub. The support rod may penetrate the first elastic member, which may elastically support the cap. The friction damper may be movably provided along the support rod and generate a certain frictional force with the support rod.

13 Claims, 13 Drawing Sheets

WASHING MACHINE WITH A SUSPENSION HAVING A FRICTION DAMPER

CROSS-REFERENCE TO RELATED APPLICATION(S)

This application claims priority to Korean Patent Application No. 10-2010-0057763 filed in Korea on Jun. 17, 2010, and No. 10-2010-0134741 filed in Korea on Dec. 24, 2010, the contents of which are incorporated herein by reference in their entirety.

BACKGROUND

1. Field

This relates to a washing machine, and more particularly, to a washing machine including a suspension.

2. Background

Generally, a washing machine includes an outer tub provided in a cabinet and an inner tub capable of rotating in the outer tub to wash laundry loaded in the inner tub. Stable operation of the washing machine may be enhanced by absorbing vibration according to a degree of vibration.

BRIEF DESCRIPTION OF THE DRAWINGS

The embodiments will be described in detail with reference to the following drawings in which like reference numerals refer to like elements wherein.

DETAILED DESCRIPTION

Figure 1:
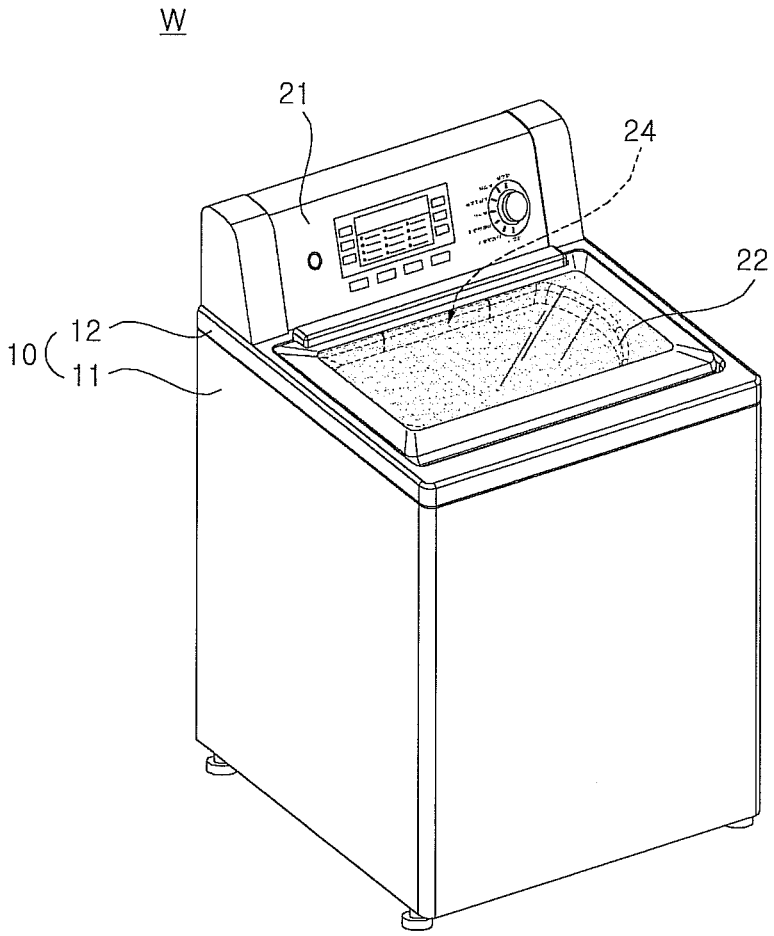
FIG. 1 is a perspective view of a washing machine according to an embodiment as broadly described herein.

The foregoing and other objects, features, aspects and advantages of the various embodiments will become more apparent from the following detailed description provided herein when taken in conjunction with the accompanying drawings. Exemplary embodiments will be described in detail below with reference to the accompanying drawings. Embodiments may include many different forms and should not be construed as being limited to the embodiments set forth herein. Thus, these exemplary embodiments are provided so that this disclosure will be thorough and complete, and will convey the scope to those skilled in the art. In the drawings, the shapes and dimensions may be exaggerated for clarity, and the same reference numerals will be used throughout to designate the same or like components.

Both a front loading washing machine in which an outer tub is horizontally disposed such that laundry is loaded from the front end thereof and a top loading washing machine in which the outer tub is vertically disposed such that laundry is loaded from the top end thereof may have the outer tub suspended in a cabinet to allow for some movement as the inner tub rotates and causes some vibration of the outer tub. Excessive vibration of the outer tub during operation of the washing machine may affect the stability and durability of the washing machine. Accordingly, a mechanism for reducing the vibration of the outer tub and/or a method for effectively reducing vibration generated during operation of the washing machine may be incorporated.

For example, washing machine may absorb vibration using one or more suspensions disposed at a plurality of locations of the outer tub to elastically support the outer tub. However, this may not take into consideration the degree of vibration of the outer tub.

For example, there may be a section within a particular cycle of operation that experiences excessive vibration, where the outer tub vibrates excessively depending on, for example, the rotation speed of the inner tub or other various causes. Effectively reducing vibration in the excessive vibration section may improve operational stability, durability and effectiveness of the washing machine.

Figure 2:
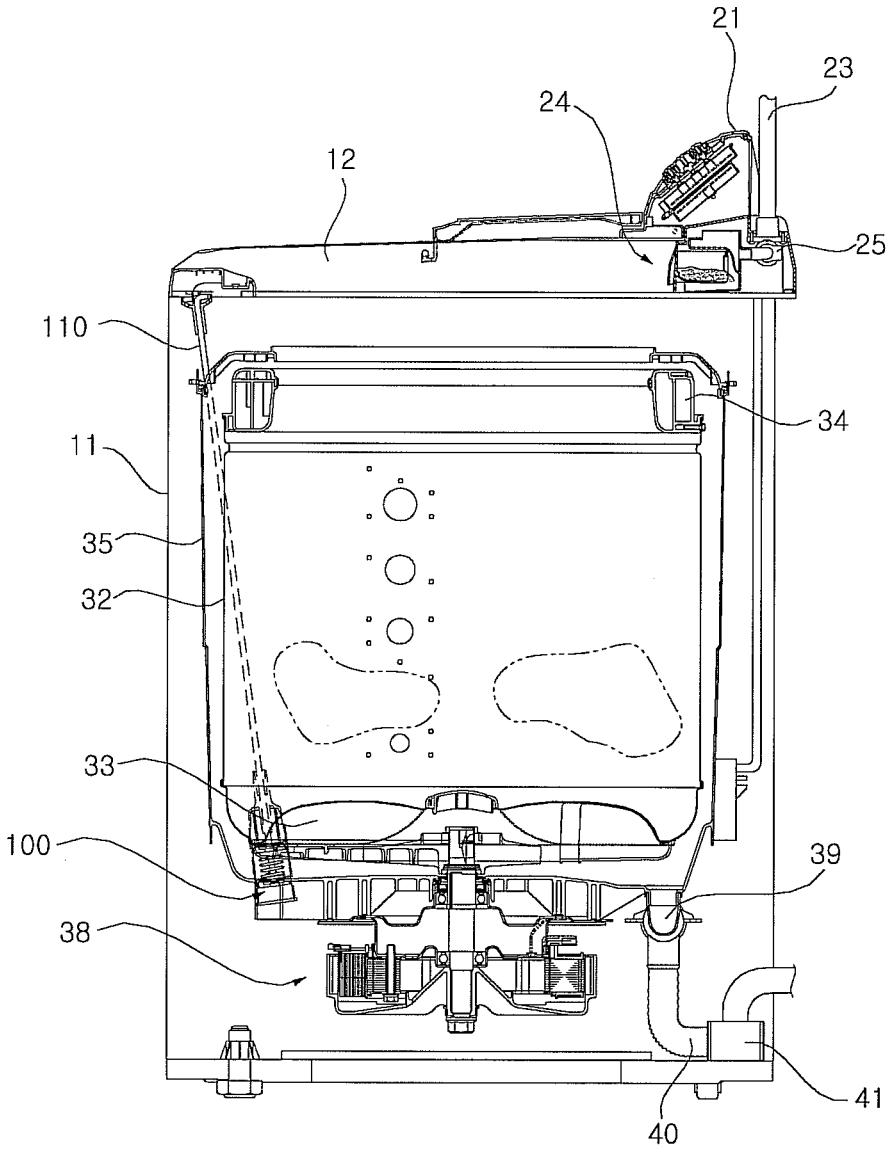
FIG. 2 is a side cross-section view of the washing machine shown in FIG. 1.

Referring to FIGS. 1 and 2, a washing machine W as embodied and broadly described herein may include a casing 10, a control panel 21, and a door 22. The casing 10 may define the exterior of the washing machine W. The control panel 21 may include various components, such as, for example, a display for displaying information related to the operation state of the washing machine W, manipulation keys for receiving various control commands, and other such components. The door 22 may be pivotably coupled to the casing 10 to open or close a laundry loading hole through which laundry is loaded into and removed from the washing machine W.

The casing 10 may include a main body 11 defining a space in which various components of the washing machine W are housed, and a top cover 12 disposed on the main body 11. In the embodiment shown in FIGS. 1 and 2, the casing 10 includes the main body 11 and the top cover 12. However, the casing 10 may merely define the exterior of the washing machine, and may be a fixed body such that one end of a support rod 110 connected to the casing 10 becomes a fixed end.

In the embodiment shown in FIGS. 1 and 2, the support rod 110 is coupled to the top cover 12, which is one of components of the casing 10, but the embodiments are not limited thereto. For example, the support rod 110 may also be coupled to a different fixed portion of the casing 10.

The washing machine W may include an outer tub 35 provided in the casing 10, an inner tub 32 provided in the outer tub 35 and receiving laundry therein, a pulsator 33 rotatably disposed at a lower portion of the inner tub 32, and a balancer 34 that compensates for eccentricity generated during the rotation of the inner tub 32. The door 22 may include a transparent section made of a material such as, for example, tempered glass that allows light to pass through, such that the interior of the inner tub 32 is visible therethrough when the laundry loading hole is closed by the door 22.

The washing machine W may include a driver 38 that provides a driving force for rotating the inner tub 32 and/or the pulsator 33. In certain embodiments, the washing machine W may include a clutch that allows only one or both of the inner tub 32 and the pulsator 33 to rotate by selectively delivering the driving force of the driver 38 thereto. A detergent box 24 that holds various kinds of additives such as detergents, fabric softeners, and/or bleaches may be retractably disposed in the top cover 12. Wash water supplied through a water supply passage 23 may be supplied to the inner tub 35 via the detergent box 24.

Wash water supplied to the inner tub 32 may be moved to the outer tub 35 through a plurality of holes that is formed in the inner tub 32. A water supply valve 25 may control flow from the water supply passage 23 into the detergent box 24 and/or the inner tub 32. Wash water may be drained from the outer tub 35 through a drain passage 40. The washing machine W may include a drain valve 39 for controlling flow between the outer tub 35 and the drain passage 40, and a drain pump 41 for pumping wash water.

The support rod 110 may suspend the outer tub 35 in the casing 10. One end of the support rod 110 may be connected to the casing 10, and the other end thereof may be connected to the outer tub 35 by a suspension 100.

The suspension 100 may buffer vibration of the outer tub 35 during operation of the washing machine W. Due to the rotation of the inner tub 32, the outer tub 35 may vibrate, thus affecting stability and durability of the washing machine W. In certain embodiments, this vibration may cause the outer tub 35 to collide with the casing 10 and generate noise.

During the rotation of the inner tub 32, there may be a section of a cycle (hereinafter, referred to as an excessive vibration section) in which the outer tub 35 excessively vibrates due to various factors such as, for example, eccentricity of laundry held in the inner tub 32, resonance characteristics, rotation speed or of the inner tub 32, and other such factors.

For example, during a spin cycle in which the inner tub 32 rotates at a relatively high speed, the outer tub 35 may vibrate within a normal range in certain section(s) of the cycle (hereinafter, referred to as a normal vibration section). As the rotation speed of the inner tub 32 increases and approaches/reaches a certain value, the vibration of the outer tub 35 may rapidly increase. For example, when there is eccentricity associated with laundry loaded in the inner tub 32, the degree of the vibration of the outer tub 32 may increase. The buffering capacity provided by the suspension 100 may exhibit different characteristics in a normal vibration section in which the outer tub 35 vibrates within a predetermined amplitude compared to a section in which the outer tub 35 vibrates beyond the predetermined amplitude.

Figure 3A:
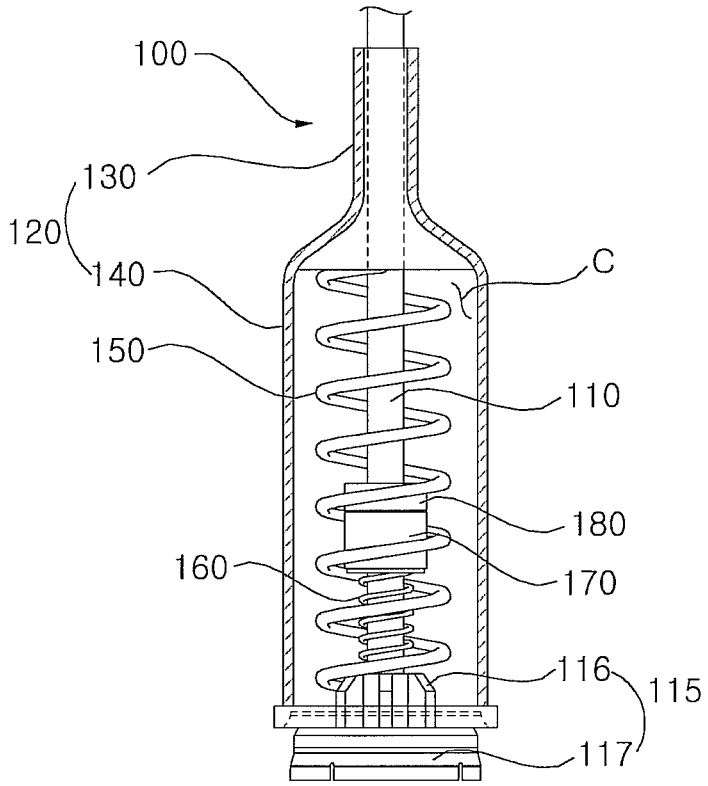
FIGS. 3A and 3B illustrate a suspension shown in FIG. 2.
Figure 3B:
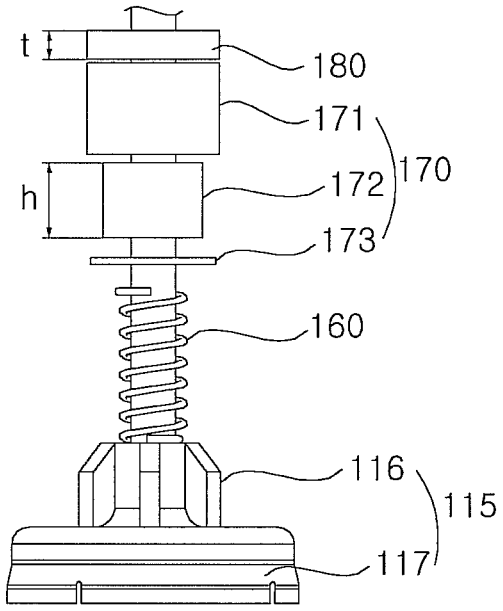

In the embodiment shown in FIGS. 3A and 3B, the suspension 100 may include a first elastic member 150 that is elastically deformed when the outer tub 35 vibrates, and a friction damper 170 that damps the vibration of the outer tub 35 using a frictional force acting on the support rod 110 when the outer tub 35 vibrates beyond a predetermined amplitude. The suspension 100 may also include a cap 120 that moves along the support rod 110 together with the outer tub 35 when the outer tub 35 vibrates, and a support plate 115 disposed on the end of the support rod 110.

The outer circumferential surface of the support plate 115 may contact and form a seal with the inner surface of the cap 120 such that air C held in the cap 120 does not leak. When the cap 120 moves upward and downward along the support rod 110 based on an amount of vibration of the outer tub 35, the support plate 115 may remain stationary while the cap 120 may move. Accordingly, the pressure of the air C held in the cap 120 may change. Particularly, when the cap 120 descends along the support rod 110, air C may be subjected to a greater compressive force and the vibration of the outer tub 35 may be damped. Accordingly, the cap 120 and the support plate 115 may function as a sort of hydraulic damper that damps the vibration of the outer tub 35 based on the amplitude of the vibration.

The support rod 110 may penetrate through the first elastic member 150, the friction damper 170, and a second elastic member 160, thus maintaining alignment with the support rod 110 by the support plate 115.

The first elastic member 150 may have a length that extends from the support plate 115 to the top of the cap 120. The second elastic member 160 may have a length and a diameter that are less than those of the first elastic member 150. The friction damper 170 and the second elastic member 160 may be disposed in the first elastic member 150. The second elastic member 160 may be disposed under the friction damper 170 to elastically support the friction damper 170.

When the cap 120 moves downward along the support rod 110, the first elastic member 150 may be primarily compressed. When the first elastic member 150 is compressed by a certain length or more, the friction damper 170 may be secondarily pushed by the cap 120, and then the second elastic member 160 may be compressed by the movement of the friction damper 170.

When the operation of the washing machine W is finished, and the outer tub 35 stops vibrating, or when the cap 120 ascends along the support rod 110 during rotation of inner tub 32, the friction damper 170 may be pushed upward by a resilient force of the second elastic member 160. Particularly, when the outer tub 35 completely stops vibrating, the friction damper 170 may be restored to its initial position.

The friction damper 170 may be movable along the support rod 110, and may damp the vibration of the outer tub 35 by a frictional force acting on the support rod 110. The frictional force may include, for example, a viscous frictional force acting between the friction damper 170 and the support rod 110.

The friction damper 170 may include a receiver 171, a friction member 172 received in the receiver 171, and a lid 173 closing the receiver 171. The friction member 172 may contact the support rod 110. The friction member 172 may have, for example, a fabric structure such as, for example, felt, or other material as appropriate, to generate a sufficient frictional force with the support rod 110. The friction member 172 may be saturated with a fluid having a relatively high viscosity filled in the receiver 171. The friction member 172 may have a thickness h sufficient to generate an appropriate level of frictional force acting between the friction damper 170 and the support rod 110.

The support plate 115 may include a seal 117 contacting the inner circumference of the cap 120, and a boss 116 protruding from the seal 117 and coupled to the support rod 110. The boss 116 may reinforce the support plate 115, and may stably support the first elastic member 150 surrounding the boss 116 without shaking.

A shock absorber 180 may be inserted onto the support rod 110 between the friction damper 170 and the cap 120. The shock absorber 180 may reduce an impact sound caused by a collision between the friction damper 170 and the cap 120.

The shock absorber 180 may be formed of a material capable of absorbing an impact and a noise. For example, the shock absorber 180 may be formed of urethane felt. A thickness t of the shock absorber 180 may be determined based on the material of the shock absorber 180 and the amount of impact which may be experienced between the friction damper 170 and the cap 120.

Figure 4:
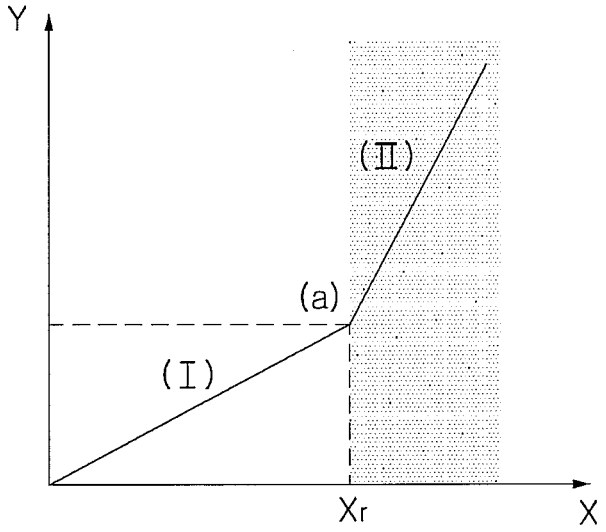
FIG. 4 is a graph of a variation of a buffering capacity with respect to a deformation length of a first elastic member of the suspension shown in FIGS. 3A and 3B.

Hereinafter, operation of the suspension 100 in response to vibration of the outer tub 35 will be described in detail with reference to FIGS. 4 and 5A-5C. The graph shown in FIG. 4 represents a variation of the buffering capacity (along the Y-axis) with respect to a deformation length (along the X-axis) of the first elastic member 150. The buffering capacity is not necessarily a strictly linear variation as shown in FIG. 4.

A region I shown in FIG. 4 may be a region in which vibration is buffered by a frictional force between a support rod receiver 130 of the cap 120 and the support rod 110 and a resilient force provided by the first elastic member 150. A region II may be a region in which vibration is buffered by a frictional force provided by the friction damper 170 and a resilient force provided by the second elastic member 160, in addition to the frictional force between the support rod receiver 130 and the support rod 110 and the resilient force provided by the first elastic member 150. A point (a) may represent a boundary between the regions I and II, at which the friction damper 170 and the second elastic member 160 begin operation.

As shown in FIGS. 3A-3B and 5A-5C, the first and second elastic members 150 and 160 may include springs. Other mechanisms which provide an appropriate elastic force may be used.

A viscous frictional force may act between the friction damper 170 and the support rod 110.

Figure 5A:
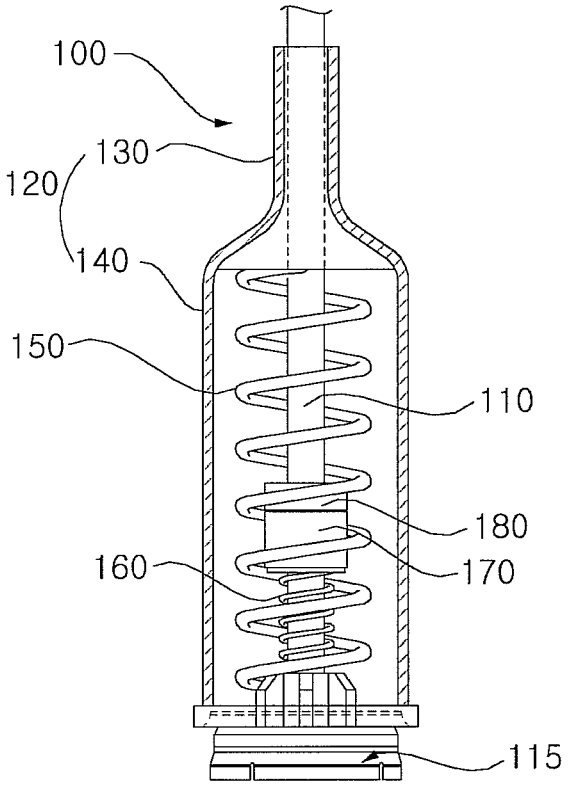
FIGS. 5A-5C illustrate an operation state of a suspension corresponding to the vibration section represented in FIG. 4.

FIG. 5A illustrates the suspension 100 in an equilibrium state. In this case, the compression length of the first elastic member 150 may be essentially 0, the compression length of the second elastic member 160 may be essentially 0, and the movement distance of the friction damper 170 may be essentially 0.

Figure 5B:
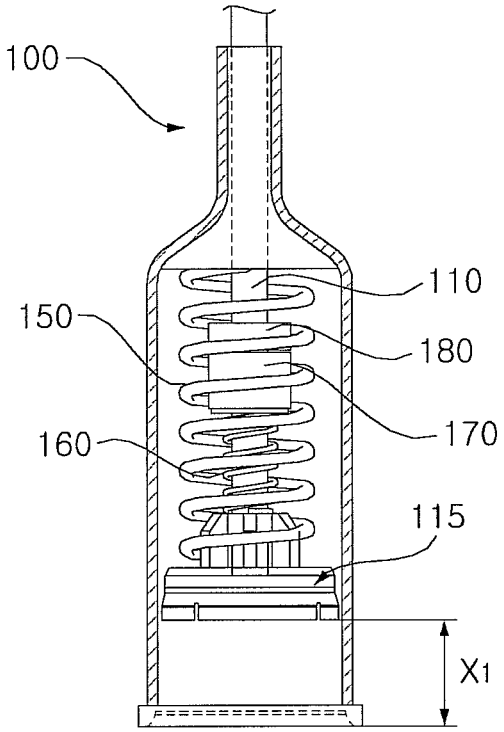

FIG. 5B illustrates the suspension 100 in a state corresponding to the region I shown in FIG. 4. In this case, the compression length of the first elastic member 150 may be X1 (X1<Xr), the compression length of the second elastic member 160 may be essentially 0, and the movement distance of the friction damper 170 may be essentially 0.

Figure 5C:
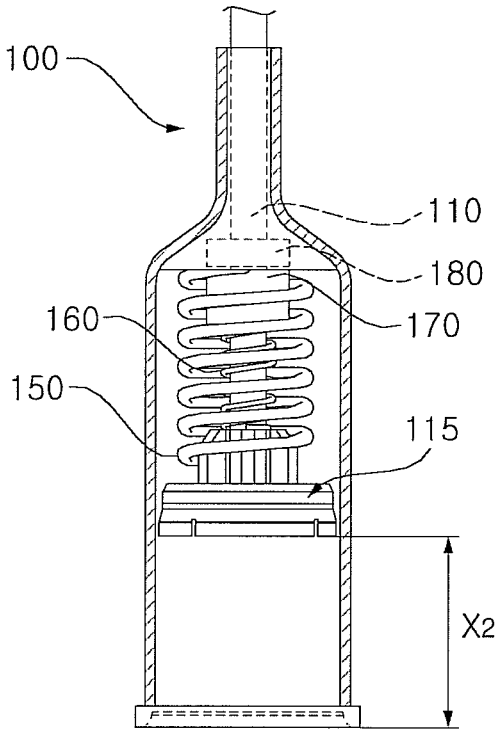

FIG. 5C illustrates the suspension 100 in a state corresponding to the region II shown in FIG. 4. In this case, the first elastic member 150 may be compressed by a length X2 (X2>Xr), the second elastic member 160 may be compressed by a certain length, and the friction damper 170 may also move by the certain length corresponding to the compression of the second elastic member 160.

As a result, vibration may be buffered by the compression of the first elastic member 150 in Region I, whereas vibration may be buffered by the compression of both of the first elastic member 150 and the second elastic member 160 and the frictional force between the friction damper 170 and the support rod 110 in Region II. Since the frictional force between the support rod receiver 130 and the support rod 110 acts in both Region I and Region II, the frictional force between the support rod receiver 130 and the support rod 110 is not necessarily taken into consideration in this particular comparison.

Accordingly, the washing machine W according to an embodiment as broadly described herein may effectively buffer vibration even in a section (Region II) of an operation cycle where the outer tub 35 vibrates beyond a certain amplitude (amplitude at the point (a)).

Figure 6:
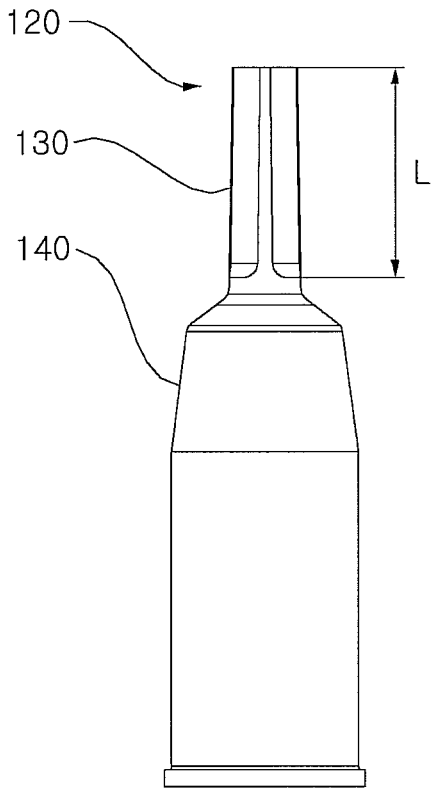
FIG. 6 illustrates an exterior of a cap of the suspension shown in FIGS. 3A and 3B.

Referring to FIG. 6, the cap 120 may include the support rod receiver 130 in which the support rod 110 is received, and a cap body 140 extending from the support rod receiver 130 and defining a certain space therein.

The support rod receiver 130 may contact the support rod 110 such that, when the cap 120 moves along the support rod 110, a frictional force may act between the support rod receiver 130 and the support rod 110 in the opposite direction to the movement direction of the cap 120.

In certain embodiments, a viscous material, such as, for example, grease, may be spread between the support rod receiver 130 and the support rod 110. Thus, when the support rod receiver 130 moves along the support rod 110, a sufficient viscous frictional force may be generated. The magnitude of the viscous frictional force may be in proportion to a contact area between the support rod receiver 130 and the support rod 110. For example, the magnitude of the viscous frictional force may be in proportion to a length L of the support rod receiver 130. Accordingly, an appropriate level of viscous frictional force corresponding to the vibration characteristics of the outer tub 35 may be generated by adjusting the length L of the support rod receiver 130.

The length L of the support rod receiver 130 may be determined in consideration of the frictional force acting between the support rod receiver 130 and the support rod 110, the frictional force acting between the friction member 172 and the support rod 110, the resilient force of the first elastic member 150, and the resilient force of the second elastic member 160.

Particularly, since the friction damper 170 moves within the cap body 140, the support rod receiver 130 may extend from the cap body 140 to the outside to avoid interference with the friction damper 170.

In this particular embodiment, the first and second elastic members 150 and 160 have been configured to be compressed in a section where the outer tub 35 descends. However, the configuration of the suspension 100 may also be modified such that the first and second elastic members 150 and 160 are compressed in a section where the outer tub 35 ascends.

Similarly, unlike this particular embodiment, the configuration of the suspension 100 may also be modified such that the friction damper 170 also moves along the support rod 110 in the section where the outer tub 35 ascends. Since the suspension 100 does not only buffer the vibration of the outer tub 35 but also suspends the outer tub 35 in the casing 10, the suspension 100 may operate such that a suspension force varies with a load of the outer tub 35, which varies based on the amount of wash water and/or laundry. For example, when the load of the outer tub 35 is less than or equal to a certain value, only the first elastic member 150 may operate. When the load of the outer tub 35 is greater than the certain value, the first elastic member 150, the friction damper 170, and the second elastic member 160 may operate together.

Figure 7:
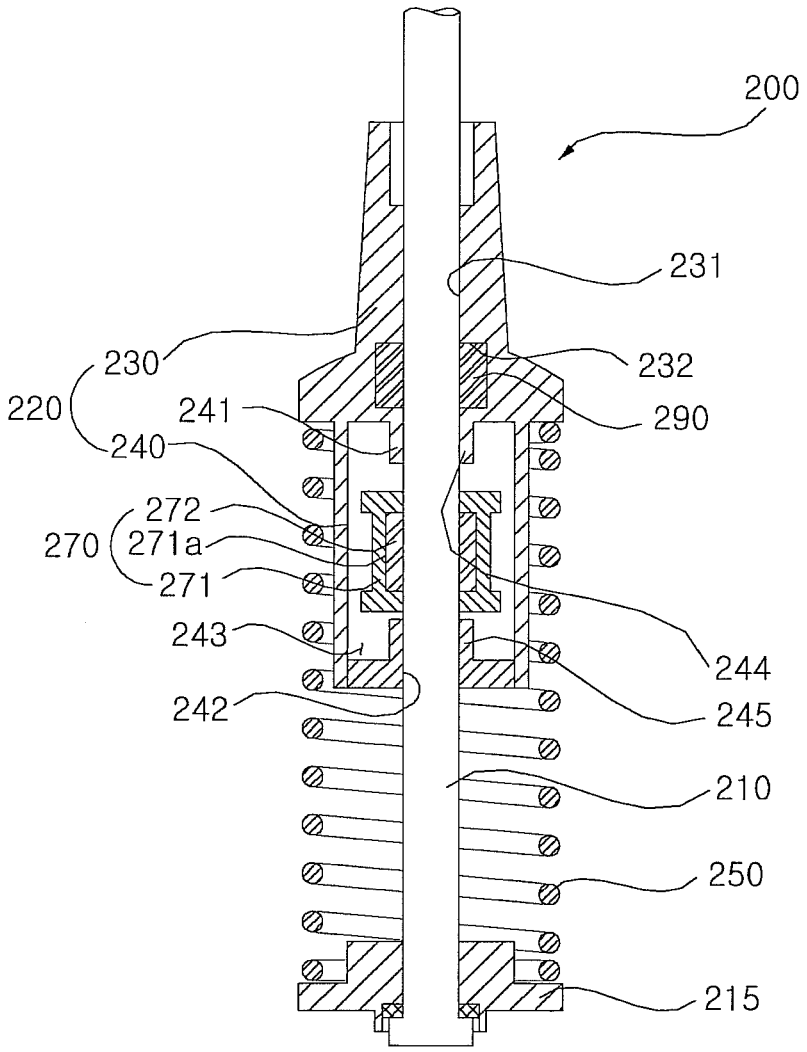
FIG. 7 is a cross-sectional view of a suspension according to another embodiment as broadly described herein.

A suspension 200 according to another embodiment shown in FIG. 7 may include a cap 220 connected to a plurality of locations of the outer tub 35, a support rod 210 penetrating the cap 220, the support rod 210 having an upper end thereof fixed to an upper portion of the casing 10 of the washing machine W at and protruding downward through the cap 220 at the other end thereof, an elastic member 250 elastically supporting the support rod 210 and the cap 220, and a plurality of friction members 272 and 290 disposed inside the cap 220 and generating different frictional forces with the support rod 210 at a plurality of portions of the support rod 210 along the axial direction of the support rod 210.

The cap 220 may include a support rod receiver 230 and a cap body 240. The support rod receiver 230 may have a first through hole 231 that receives the support rod 210 therethrough, and a first friction member installation hole 232 in which a first friction member 290 is installed such that the inside of the first friction member 290 is exposed to the first through hole 231. The cap body 240 may have second through holes 241 and 242 through which upper and lower ends of the support rod 210 penetrate, respectively, and an inner space 243 in which a friction damper 270 shown in FIGS. 7 and 8 or a friction damper 370 shown in FIGS. 9 and 10 may move.

In certain embodiments, the support rod receiver 230 may have a tapered shape, whose thickness is gradually reduced from the lower end to the upper end. The first friction member 290 may be disposed in the first friction member installation hole 232 formed at the lower end of the support rod receiver 230. The first friction member 290 may have a substantially cylindrical shape so that the outer circumference of the first friction member 290 fitted into the first friction member installation hole 232 may be tightly fixed on the inner circumference of the first friction member installation hole 232. The inner circumference of the first friction member 290 may contact the outer circumference of the support rod 210 to generate a first frictional force with the support rod 210.

The cap body 240 may have a substantially cylindrical shape and may be disposed under the support rod receiver 230. Particularly, the diameter of the cap body 240 may be less than the diameter of the lower end of the support rod receiver 230, thereby forming a stepped portion between the lower end of the support rod receiver 230 and the upper end of the cap body 240. In certain embodiments, the support rod receiver 230 and the cap body 240 may be formed integrally. In alternative embodiments, the support rod receiver 230 and the cap body 240 may be formed separately and coupled to each other through a screw-coupling, hook-coupling, or other coupling method as appropriate.

The friction damper 270 may include a receiver 271 and a second friction member 272 received in the receiver 271. The second friction member 272 may have a substantially cylindrical shape, and may be disposed in the receiver 271 such that the inner circumference of the second friction member 272 contacts the outer circumference of the support rod 210. Accordingly, the second friction member 272 may generate a second frictional force by contacting the outer circumference of the support rod 210.

Figure 8:
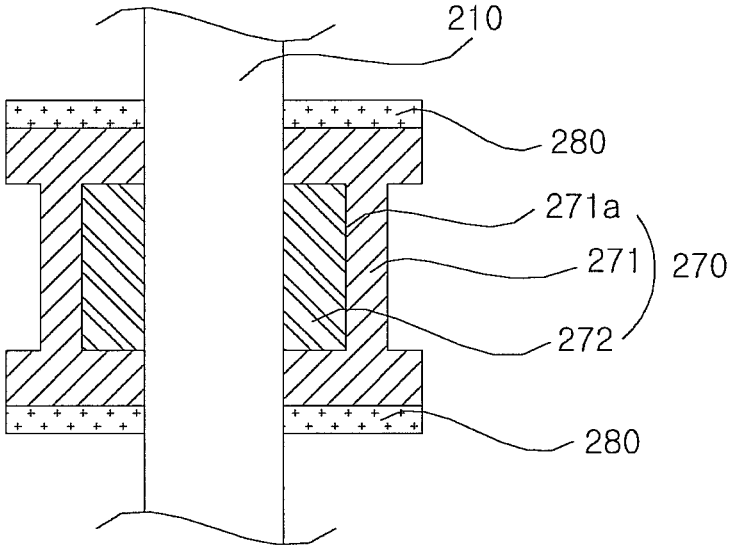
FIG. 8 is a partial cross-sectional view of a shock-absorbing member provided in a receiving part of the suspension shown in FIG. 7.

As shown in FIGS. 7 and 8, the receiver 271 may have a hollow shape that allows the support rod 210 to penetrate through, and may have an insertion hole 271*a* which the second friction member 272 inserted into such that the inner circumference of the second friction member 272 is exposed to the outside.

Figure 9:
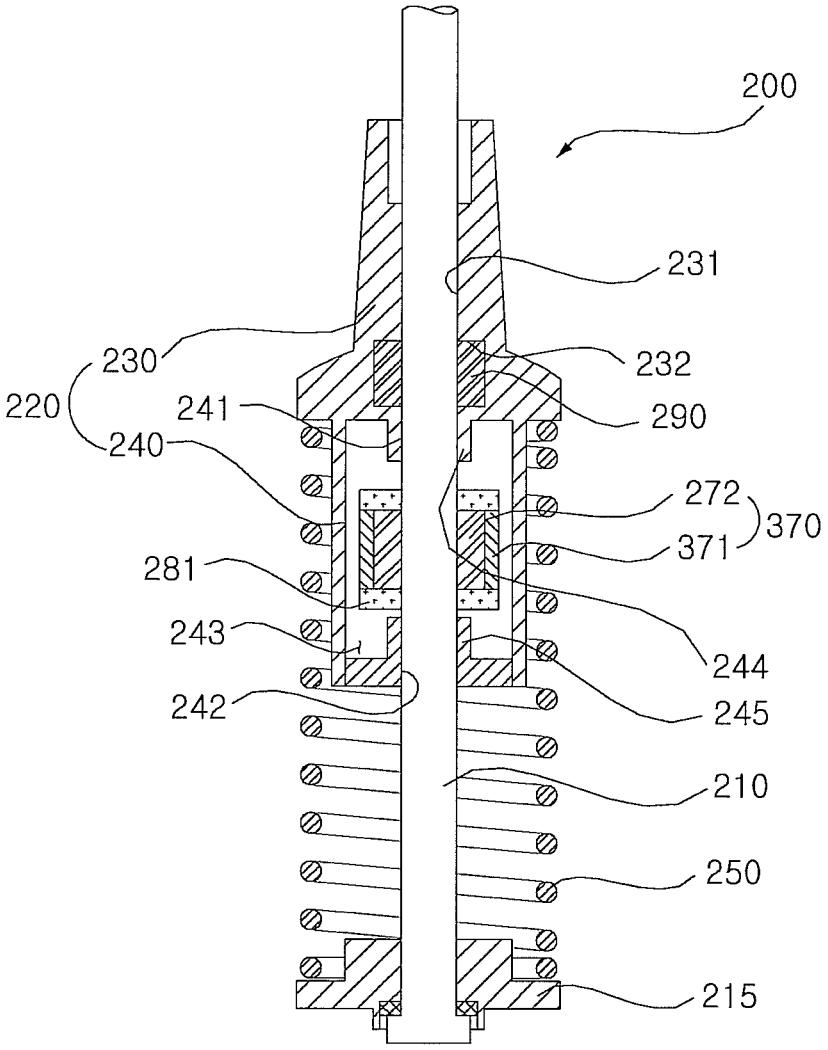
FIG. 9 is a cross-sectional view of a suspension according to another embodiment as broadly described herein.
Figure 10:
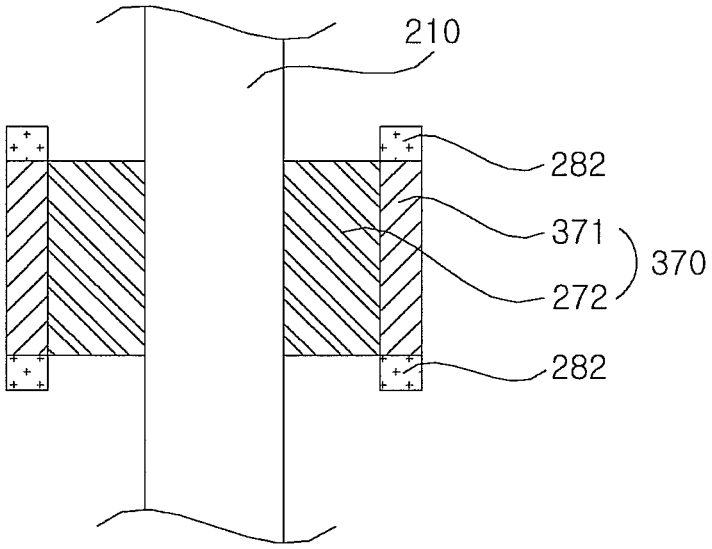
FIG. 10 is a partial cross-sectional view of a shock-absorbing member provided in a receiving part of the suspension shown in FIG. 9.

Alternatively, as shown in FIGS. 9 and 10, the receiver 371 may have a substantially cylindrical shape such that the second friction member 272 is fitted therein.

In certain embodiments, the receivers 271 and 371 may have a plurality of fixing protrusions on the inner circumference thereof. The plurality of fixing protrusions may have a sharp tip, and may be inserted into the second friction member 272 to fix the second friction member 272 in the receiver 271/371.

A support plate 215 having a disc shape may be disposed on one end of the support rod 210 that penetrates through the first and second through holes 241 and 242 of the cap body 240 of the cap 220.

The elastic member 250, which may be, for example, a spring, having a certain elasticity may be disposed between the bottom of the support rod receiver 230 and the top of the support plate 215. The elastic member 250 may be fitted to the support rod 210. Accordingly, the elastic member 250 may elastically support the cap 220 that can move along the support rod 210, based on the support plate 215.

The first friction member 290 may be disposed in the support rod receiver 230 so as to be located in a region where the elastic member 250 is not disposed. The second friction member 272 may be disposed in the inner space 243 of the cap body 240, which falls within an elastic region surrounded by the elastic member 250. Accordingly, as shown in FIG. 7, the first friction member 290 may be disposed over the second friction member 272 along the support rod 210.

Also, the first friction member 290 may generate a frictional force that is less than that generated by the second friction member 272. The first frictional force of the first friction member 290 may be less than the second frictional force of the second friction member 272 by a certain magnitude. Accordingly, when the cap 220 moves along the support rod 210, it is possible to sequentially generate different frictional forces.

Referring to FIGS. 7 and 9, two stoppers 244 and 245 may be disposed in the inner space 243 of the cap body 240 to limit the vertical movement of the receivers 271 and 371 and the second friction member 272 that move upward and downward according to the vertical movement of the cap 220. A first stopper 244 may protrude from the first through hole 241 at the upper portion of the inner space 243, and a second stopper 245 may protrude from the second through hole 242 at the lower portion of the inner space 243. The stoppers 244 and 245 may extend toward a central portion of the inner space 243, in opposite directions to each other in the inner space 243, and may have different extension lengths from each other. The stoppers 244 and 245 may each have a hole formed therein through which the support rod 210 penetrates.

Hereinafter, a vibration-absorbing process of the suspension 200 will be described in detail.

When the driver 38 operates, the inner tub 32 axially-connected thereto may rotate at a certain rotation speed. Vibration generated in this case may be delivered to the outer tub 35 surrounding the inner tub 32. The vibration delivered to the outer tub 35 may be delivered to the cap 220 connected a plurality of portions of the outer tub 35. Accordingly, the cap 220 may move upward and downward.

Referring to FIG. 7, when the cap 220 moves downward, the first friction member 290 disposed in the support rod receiver 230 may generate a first frictional force with the outer circumference of the support rod 210. Thus, the vibration delivered from the outside may be primarily absorbed.

When the cap 220 further moves downward and exceeds the first frictional force, a second frictional force may be generated between the outer circumference of the support rod 210 and the second friction member 272 disposed in the inner space 243. Thus, a greater amount of vibration may be absorbed by the second friction member 272.

The above process has been described on the assumption that the first frictional force is less than the second frictional force. According to embodiments as broadly described herein, vibration delivered to the cap 220 moving upward and downward may be absorbed in multiple steps or sequentially by the frictional members 272 and 290 that are disposed along the axial direction of the support rod 210 and generate different frictional forces with the outer circumference of the support rod 210. Thus, the rotation of the inner tub 32 may be stably supported by sequentially buffering vibration generated at the outer tub 35.

On the other hand, since the receivers 271 and 371 shown in FIGS. 7 through 10 move upward and downward along the support rod 210, noise may be generated from a collision between the top and bottom of the receivers 271 and 371 and the upper and lower inner wall of the inner space 243 or two stoppers 244, 245. Accordingly, shock absorbers 280, 281 and 282 may be provided on the top surface and the undersurface of the receivers 271 and 371 in order to reduce/prevent noise.

The shock absorbers 280, 281 and 282 may be formed of, for example, felt having a certain thickness and a sound-absorbing function.

In certain embodiments, the shock absorbers 280, 281 and 282 may be disposed on the outer surface of the stoppers 244 and 245 shown in FIG. 7 to have a certain thickness. Accordingly, noise generated when the upper and lower ends of the receivers 271 and 371, which move vertically along the axial direction of the support rod 210 in the inner space 243, collide with the outer surfaces of the stoppers 244 and 245 can be easily absorbed.

Alternatively, as shown in the embodiment of FIG. 8, the support rod 210 may penetrate the shock absorber 280, and may be formed in a certain thickness on the top surface and undersurface of the receiver 271 in which the second friction member 272 is fitted, respectively. Accordingly, noise generated when the upper portion and lower portion of the receiver 271 moving upward and downward along the support rod 210 in the inner space 243 collide with the stoppers 244 and 245 may be absorbed.

As shown in FIG. 9, the shock absorber 281 may be formed so as to seal the upper and lower portions of the receiver 371 except a region which the support rod 210 having a cylindrical shape penetrates through. In this case, the second friction member 272 may be surrounded by the receiver 371 and the shock absorber 281 to be protected from the outside. Also, noise generated when the upper portion and lower portion of the receiver 371 moving upward and downward along the support rod 210 in the inner space 243 collides with the stoppers 244 and 245 may be absorbed.

As shown in FIG. 10, the shock absorber 282 may be formed only on the top surface and undersurface of the receiver 371 having a substantially cylindrical shape. Since the upper and lower portions of the receiver 371 where the shock absorber 282 is formed collide with the stoppers 244 and 245, the shock absorber 282 may easily absorb noise caused by the collision between the upper and lower portions of the receiver 371 and the respective stoppers 244 and 245.

The shock absorbers 280, 281 and 282 may also absorb an impact force generated from the collision with the stoppers 244 and 245, in addition to noise generated from the collision between the receivers 271 and 371 and the stoppers 244 and 245. Noise and impact force may be reduced in the inner space 243 that is isolated from the outside, and may be prevented from being delivered to other components of the suspension 200. Accordingly, the lifespan of the suspension 200 may also be extended.

It is noted that, simply for ease of discussion and illustration, a suspension as embodied and broadly described herein has been applied to a top loading washing machine having a cylindrical tub with a laundry opening provided at a top end thereof. However, a suspension as embodied and broadly described herein may also be applied to a front loading washing machine having a substantially horizontally oriented cylindrical tub and a laundry opening formed at a front axial end thereof; or to a top loading washing machine having a horizontally oriented cylindrical tub with closed axial ends and a laundry opening formed in its cylindrical wall facing a front end of the cabinet.

A washing machine according to an embodiment as broadly described herein may effectively buffer vibration of an outer tub according to the vibration characteristics of the outer tub.

Also, a washing machine according to an embodiment as broadly described herein may improve stability and durability thereof.

Also, a washing machine according to an embodiment as broadly described herein may reduce noise generated from vibration thereof.

Furthermore, a washing machine according to an embodiment as broadly described herein may secure a sufficient buffering capacity even in an excessive vibration section.

In addition, a washing machine according to an embodiment as broadly described herein may sequentially absorb vibration generated in an outer tub thereof along the axial direction of a support rod connected to the outer tub.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine, comprising:

a casing;

an outer tub provided in the casing;

an inner tub rotatably provided in the outer tub; and a suspension coupled between the outer tub and the casing, wherein the suspension includes:

a support rod having a first end thereof connected to the casing;

a support plate, to which a second end of the support rod is fixed;

a cap movably coupled to the support rod, wherein the support rod penetrates the cap and the cap moves upward and downward along the support rod in response to vibration of the outer tub;

a first elastic member that elastically supports the cap, wherein the support rod penetrates the first elastic member; and a friction damper movably coupled to the support rod, wherein the friction damper generates a frictional force with the support rod, wherein the cap includes a cap body having a pair of through holes, respectively, formed at an upper end and a lower end thereof, and an inner space defined therein, wherein the support rod extends through the pair of through holes of the cap body, and the friction damper is housed within the inner space of the cap body, wherein a bottom end of the first elastic member is fixed to and supported by the support plate and the cap body is provided within the first elastic member, and wherein the friction damper engages the upper end of the cap body when the first elastic member is deformed greater than a predetermined amount, disengages from the upper end of the cap body as the first elastic member is restored from a deformed state of the predetermined amount, and engages with the lower end of the cap body as the first elastic member is further restored.

2. The washing machine of claim 1, wherein the suspension further includes a first friction member, which is fixed in the cap and contacts an outer circumferential surface of the support rod so as to generate a first frictional force, and wherein the friction damper includes a second friction member that contacts the outer circumferential surface of the support rod so as to generate a second frictional force.

3. The washing machine of claim 2, wherein the cap further includes a support rod receiver having a through hole formed therein, through which the support rod is received, and a first friction member installation recess, in which the first friction member is received, such that an inner side of the first friction member is exposed to the through hole of the support rod receiver, and wherein the support rod receiver is connected to the cap body.

4. The washing machine of claim 3, wherein a top end of the first elastic member is fixed to and supported by a bottom surface of the support rod receiver which forms a step with a top end of the cap body such that the cap body is positioned within the first elastic member and the support rod receiver is positioned outside of the first elastic member.

5. The washing machine of claim 2, wherein the friction damper includes a receiver in which the second friction member is received.

6. The washing machine of claim 5, wherein the receiver has a hollow cylindrical shape such that the second friction member is fitted to an inner circumferential surface thereof, and wherein an inner circumferential surface of the second friction member contacts the outer circumferential surface of the support rod to generate the second frictional force.

7. The washing machine of claim 6, further including at least one shock absorber provided on a top surface or a bottom surface of the receiver.

8. The washing machine of claim 6, further including a first shock absorber provided at an upper end of the receiver and a second shock absorber provided at a lower end of the receiver, wherein the first and second shock absorbers, respectively, contact an upper end and a lower end of the second friction member.

9. The washing machine of claim 2, wherein the second friction member is provided in a first region of the cap which is surrounded by the first elastic member, and wherein the first friction member is provided in a second region of the cap which is not surrounded by the first elastic member.

10. The washing machine of claim 2, wherein the first frictional force is less than the second frictional force.

11. The washing machine of claim 1, wherein the cap body includes a pair of stoppers that respectively extends from the pair of through holes toward a center of the inner space of the cap body.

12. The washing machine of claim 11, further including a pair of shock absorbers respectively provided adjacent the pair of stoppers.

13. The washing machine of claim 1, wherein the upper and lower end of the cap body are spaced a distance apart from each other, wherein the distance is longer than a length of the friction damper measured along a direction in which the support rod is elongated.

* * * * *